US005862886A

United States Patent [19]

Bennett et al.

[11] Patent Number: 5,862,886

[45] Date of Patent: Jan. 26, 1999

[54] PRETORQUE TO UNLOAD ELEVATOR CAR/ FLOOR LOCKS BEFORE RETRACTION

[75] Inventors: Paul Bennett, Waterbury; Bruce A. Powell, Canton; Samuel C. Wan, Simsbury; Anthony Cooney, Unionville; Richard C. McCarthy, Simsbury; Joseph Bittar, Avon; Frederick H. Barker, Bristol; John K. Salmon, deceased, late of South Windsor; LucyMary Salmon, executor, South Windsor, all of Conn.

[73] Assignee: Otis Elevator Company, Farmington, Conn.

[21] Appl. No.: 564,028

[22] Filed: Nov. 29, 1995

[51] Int. Cl.[6] ..... B66B 1/40; B66B 5/16

[52] U.S. Cl. ..... 187/292; 187/282; 187/414

[58] Field of Search ..... 187/292, 282, 187/288, 294, 299, 414, 400, 291, 350, 357, 359, 361, 364, 365, 278, 283, 285

[56] References Cited

U.S. PATENT DOCUMENTS

| | | | |
|---|---|---|---|
| 1,398,216 | 11/1921 | Barnette | 187/29 |
| 3,407,904 | 10/1968 | Trollope | 187/29 |
| 3,477,548 | 11/1969 | Trollope | 187/29 |
| 4,754,850 | 7/1988 | Caputo | 187/115 |
| 5,157,228 | 10/1992 | Ackermann et al. | 187/112 |
| 5,228,537 | 7/1993 | Pfleger et al. | 187/8.5 |
| 5,424,498 | 6/1995 | Spiebauer et al. | 187/292 |
| 5,583,326 | 12/1996 | Sors | 187/277 |
| 5,635,688 | 6/1997 | Kantesaria et al. | 187/292 |

FOREIGN PATENT DOCUMENTS

| | | | |
|---|---|---|---|
| 5-097344 | 4/1993 | Japan | B66B 5/26 |
| 5-338959 | 12/1993 | Japan | B66B 9/00 |

*Primary Examiner*—Robert Nappi

[57] ABSTRACT

To prevent elevator rope stretch effects when a horizontally transferable elevator cab (18) is rolled onto and off of an elevator car frame (10), an elevator car/floor lock (31) includes a bolt (47) which extends across the interface between the car frame and the building and engages a strike (39). Jack screw (44) and solenoid (60) embodiments are shown. To take the weight off the lock bolts so that they may be retracted to permit moving the car frame vertically in the hoistway, strain gages (64, 65) or load sensors (62, 63) provided in or adjacent the bolts sense the weight supported thereby, and a pretorque program (FIG. 6) provides armature current to the hoisting motor to raise or lower the car frame sufficiently to reduce the load on the bolts to nil.

7 Claims, 3 Drawing Sheets

PRETORQUE TO UNLOAD ELEVATOR CAR/FLOOR LOCKS BEFORE RETRACTION

TECHNICAL FIELD

This invention relates to unloading elevator car/floor locks by a pre-torque program which causes hoistway motor armature current that reduces the loading on the locks to nil.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in U.S. Pat. No. 5,657,835. Since the loading and unloading of passengers takes considerable time, in contrast with high speed express runs of elevators, another way to increase hoistway utilization, thereby decreasing core requirements, includes moving the elevator cab out of the hoistway for unloading and loading, as is described in a commonly owned, copending U.S. patent application Ser. No. 08/565,648, filed contemporaneously herewith.

When an elevator cab is removed from a car frame, the stretch in the roping system, particularly at lower floors, may be sufficient to snap the elevator car frame upwardly. Thus, perturbations could be put into the system and damage done to various components of the elevator and/or the building. Similarly, if an empty car frame is brought to a landing and a cab is loaded thereon, the loading of the first portion of the cab may stretch the roping sufficiently to lower the car frame an impermissible amount below the landing, prior to the cab being fully loaded thereon.

To overcome the effects of rope stretch, car/floor locks may be used as disclosed in a commonly owned, copending U.S. patent application Ser. No. 08/565,648, filed contemporaneously herewith. However, if there is a significant change in the amount of weight on the car frame as the car stands on the landing, the car locks may be bound by downward forces due to increased weight on the car locks, or by upward forces due to rope stretch accompanied by less weight in the car frame. The bound locks may be difficult to unlock.

DISCLOSURE OF INVENTION

Objects of the present invention include using the roping system to remove all loadings on locks used to lock an elevator car frame to a building during the loading and unloading of a horizontally moveable cab.

According to the present invention, a pretorque routine for an elevator hoisting system adjusts the current in the hoisting motor so as to cause the roping system to exactly balance the load on the elevator car frame, thereby reducing vertical forces on the car/floor locks to nil, whereby the locks may be retracted.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
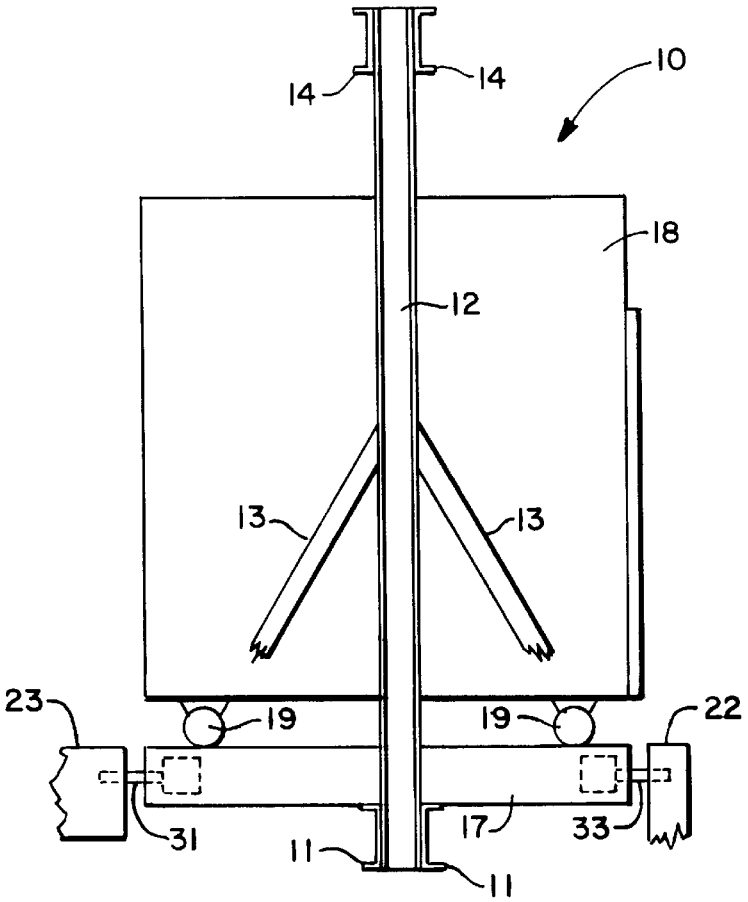
FIG. 1 is a simplified, side elevation view of an elevator car frame carrying a horizontally moveable cab, with car/floor locks of the invention engaged.
Figure 2:
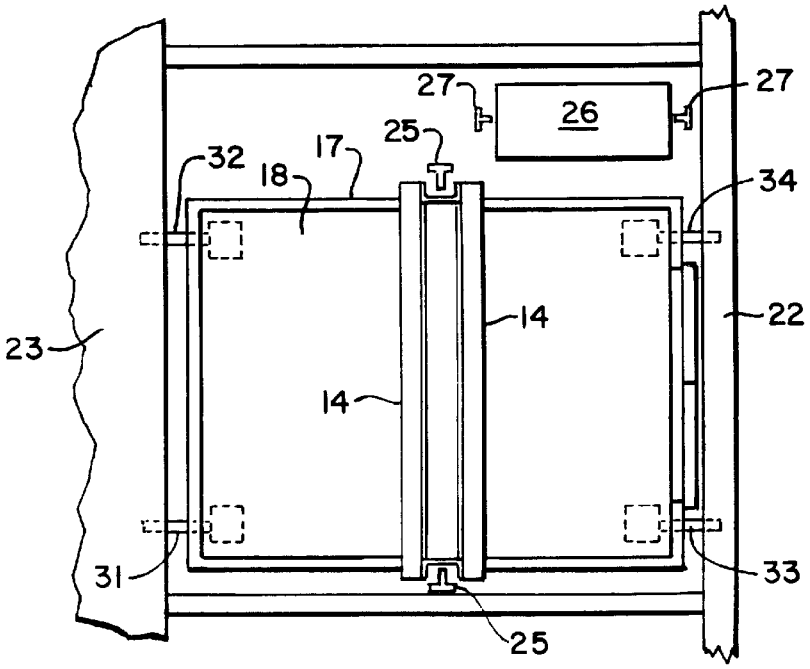
FIG. 2 is a simplified top plan view of the elevator car of FIG. 1.

Referring now to FIG. 1, an elevator car frame 10 may include a plank 11, one or more stiles 12 with braces 13 (which have been broken away for visibility), and a cross-head 14, all in the usual fashion. A platform 17 is supported by the plank 11 and the supports 13, and carries an elevator cab 18 which can be rolled on and off the elevator frame 10 by means of rollers or wheels 19. As disclosed in said U.S. patent application Ser. No. 08/564,534, the elevator cab 18 may be slidable from the platform 17 of one car frame across a sill 22 to another, similar car frame disposed to the right of that shown in FIG. 1, or it may be rolled to or from a landing 23 at a suitable floor of a building, for the purpose of transferring passengers, or otherwise. As seen in FIG. 2, the elevator car frame 10 moves vertically between guide rails 25, adjacent to a counterweight 26 which moves in the opposite direction between similar guide rails 27, all in the well-known way. The remaining elevator structure is conventional, and is not shown.

The elevator car frame 10 is locked rigidly in place by a plurality of car/floor locks 31–34, which extend across the interface between the platform 17 and either the sill 22 or the landing 23, as set forth in said U.S. patent application Ser. No. 08/565,648. The locks prevent movement of the car frame 10 and whipping of the support ropes as a consequence of a significant change in the weight being supported by the ropes, as the cab 18 is removed from the car frame, particularly when another cab does not simultaneously replace it, as is the case in said co-pending application Ser. No. 08/564,534.

Figure 3:
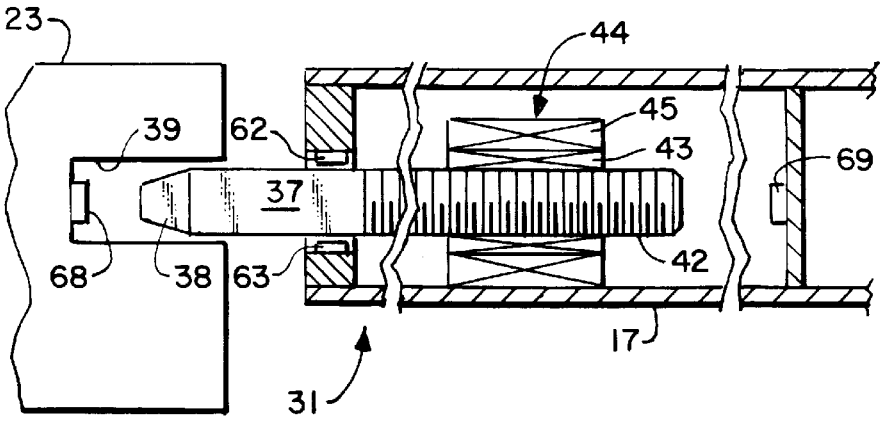
FIG. 3 is a partial, partially sectioned, side elevation view of a first embodiment of a car/floor lock of FIG. 1.

In FIG. 3, a car/floor lock may be disposed in any suitable way within the platform 17. In this embodiment, the bolt 37 of the lock consists of a square steel shaft which has its distal end 38 tapered on all four sides, to facilitate insertion of the bolt into a strike 39 formed in the structure of the landing 23 (in the case of the car/floor bolts 31, 32, or in the sill 22 in the case of the car/floor bolts 33, 34). The bolt 37 is formed integrally (or otherwise) with a threaded shaft 42 which engages the internal threads of a hollow rotor 43 of an electric motor 44 that includes a stator 45. The shaft 43 and motor 44 comprise a well-known jack screw. Typically, current in one polarity will cause rotation of the rotor in a direction to cause the bolt 37 to extend outwardly toward the strike 39, whereas current in the opposite direction will cause rotation of the rotor 43 so as to cause the bolt 37 to retract wholly within the platform 17. The bolt 37 always remains where it was last positioned, even during power failure.

Figure 4:
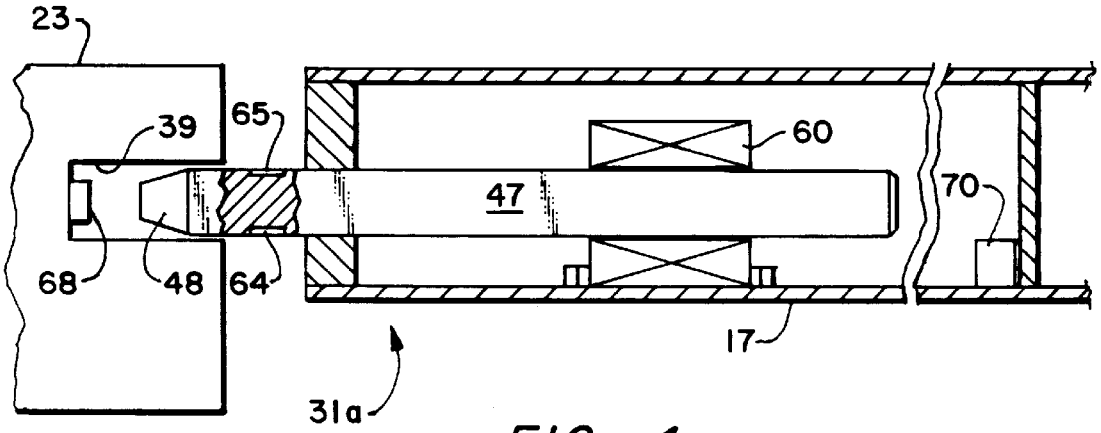
FIG. 4 is a partial, partially sectioned, side elevation view of a second embodiment of a car/floor lock of FIG. 1.

In FIG. 4, a bolt 47 of a car/floor lock 31*a* has a similarly tapered end 48 to facilitate entry into the strike 39. The bolt 47 is made of magnetic material, magnetized with one end a north pole and the other end a south pole. A solenoid 60 will cause the bolt 47 to extend leftwardly (as seen in FIG. 4) so that its distal end 48 will enter the strike 39, as shown, in response to current of one polarity; it will retract the bolt in response to current of the opposite polarity. As shown, the bolt 47 has not been extended to its full leftward position. When power is removed from the solenoid 60, the bolt 47 will remain where it was. In this embodiment, therefore, loss of power or other failure will not result in the car/floor locks becoming either engaged or retracted.

In order to pretorque the elevator motor, so that the motor is holding the entire weight of the elevator car prior to retracting the car/floor locks 31–34, some means is required to determine the weight or strain on the car/floor locks 31–34 during the pretorque procedure. In the embodiment of FIG. 3, load cells 62, 63 are disposed on the platform above and below the bolt 37 so as to provide a measure of the net weight of the elevator car. The load cells 62, 63 may be operated differentially, and a convention may be chosen (for illustrative purposes herein) that excess weight on the load cell 62 will provide a positive signal resulting in positive armature current during pretorque whereas a light cab will result in force applied to the cell 63 which yields a negative signal to result in negative armature current in balancing the cab during the pretorque process. This is as described hereinafter.

An alternative means of providing a measure of car/counterweight weight differential may comprise differentially connected strain gages 64, 65 illustrated in FIG. 4. These may be embedded in the bolt 47 so as to permit the bolt to slide horizontally without interference, as shown. A similar convention can be taken so that if the bolt 47 bends concave downwardly, as a result of excess car weight, the differential signal from the strain gages 64, 65 will be positive, resulting in positive armature current in the pretorque car leveling process, and bending of the bolt 47 concave upwardly would result in negative signals and armature current. Of course, the load cells 62, 63 can be used with the bolt 47 rather than the strain gages 64, 65, and the strain gages 64, 65 may be embedded in the bolt 37, eliminating the need for the load cells 62, 63. Or, both load cells 62, 63 and strain gages 64, 65 can be used with either of the bolts 37, 47, if desired. On the other hand, other means may be utilized to provide a measure of car loading, and other means may be utilized to cause the bolts to engage the strike and to retract, as desired.

In order to determine when the locks are safely engaged, a microswitch 68 may be provided at the base of the strike 39. Similarly, as seen in FIG. 3, a microswitch 69 may be provided at the extreme retracted position of the shaft 42. Alternatively, as seen in FIG. 4, a proximity detector 70 might be provided at the extreme retracted position of the shaft 55. Other ways may be chosen to provide means for detecting the position of the car/floor locks 31–34, in their fully locked and fully retracted positions, respectively.

Figure 5:
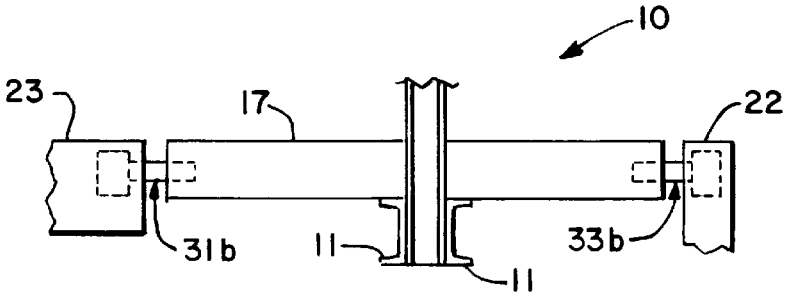
FIG. 5 is a partial, simplified side elevation view of an elevator car frame with car floor locks of an alternative embodiment of the invention engaged.

The present invention has been disclosed in an embodiment which includes one set of car/floor locks 31–34 disposed on an elevator car frame. This requires that only the strike 39 for each lock be provided at any floors where cab transfers can take place, which generally is only at one or both ends of a hoistway (rather than at many floors inbetween). The embodiment disclosed therefore requires fewer car/floor locks 31–34 than would be required if transfer of the cab could take place at both ends of the shaft and the locks were provided on the shaft rather than on the car frame. On the other hand, car frame weight and complexity can be reduced by mounting the car/floor locks 31–34 on the building steel in the hoistway and providing the corresponding strikes in the car frame, as illustrated briefly in FIG. 5. The second embodiment reduces the power requirements on the car frame 10, and the signals required to be carried to and from the car frame 10, typically by a traveling cable. However, if the elevator may transfer cabs at a large number of stops, then the embodiments of FIGS. 1–4 may be preferable to that of FIG. 5.

In FIGS. 1 and 2, the bolts are shown being at the interface at the front of the elevator, and at the rear of the elevator. Where the elevator cab is being rolled across the interface at the front or at the rear, or both, placing the locks on the front and rear interfaces is to be preferred. However, in any embodiment where desired or necessary, the locks may be provided on the sides of the elevator car frame if suitable structure is provided therefor, or may be provided on all sides. All this is irrelevant to the present invention. Similarly, the load cells 62, 63 may be disposed within the strike 39 in either the embodiments of FIGS. 1–3, or the embodiment of FIG. 5.

When the elevator car frame is brought to rest at a landing, in the normal fashion, and then the brake is set, the car/floor locks are activated by a signal command from the car controller in a fashion which suits any implementation of the invention. Examples of the manner of commanding the locks to lock are disclosed in the aforementioned applications. Basically, as soon as the brake has been commanded to drop and speed has reached zero, the floor locks are engaged.

When the car frame is locked fully to the building, it is impossible to use any of the prior art methodology for pretorquing the motor so that the motor will have sufficient current to hold the car still when the brake is released. It is possible to use open ended prior art techniques, which, from the weight of the elevator car or the weight of the cab on the car frame, and empirical data previously provided, simply estimate the precise amount of armature current necessary to totally balance the load in the car before the brake is lifted. However, transferring passengers on long elevator runs and then horizontally moving cabs between elevator car frames creates significant passenger anxiety. A rollback or rollforward due to mismatch of pretorque armature current would add to the anxiety by an impermissible amount. Further, the force required to retract the car/floor locks could be excessive unless the weight on the locks is reduced to nil. It is therefore necessary to perform a secondary pretorque operation in a closed-loop fashion after the brake is lifted so that there is no force on the locks.

Figure 6:
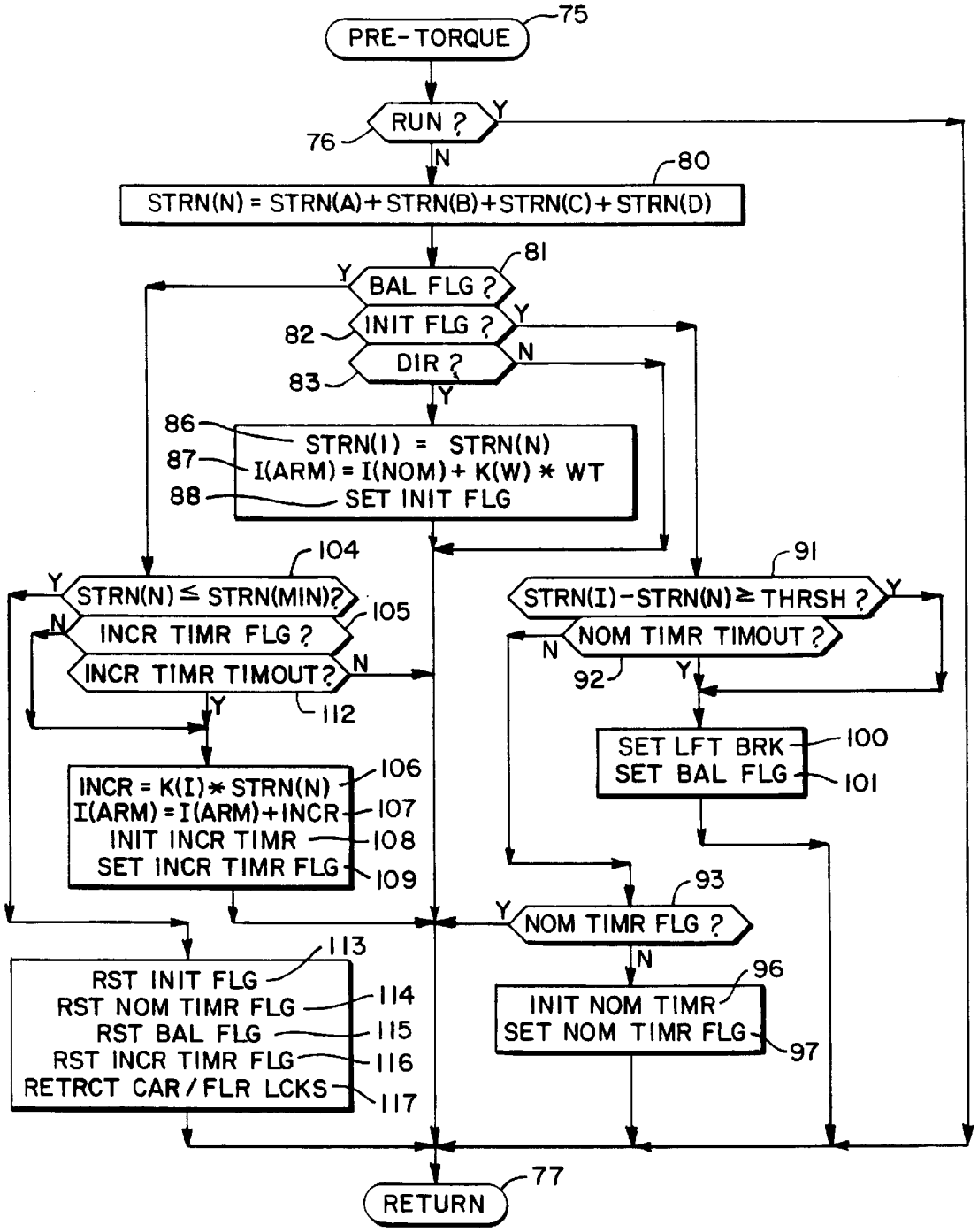
FIG. 6 is a logic flow diagram of an elevator motor pre-torque control routine exemplary of practicing the present invention.

In FIG. 6, a pretorque routine is reached through an entry point 75, and a first test 76 determines if the elevator is running or not. If it is, there is no need for any pretorque function, so the routine of FIG. 6 is bypassed and other programming is reached through a return point 77. If the car is not running, a negative result of test 76 reaches a step 80 to generate a signal indicative of the strain in a current cycle, N, as the summation of strain in all four of the car/floor locks 31–34 (referred to here as A through D). Although "strain" is referred to in FIG. 6, it should be obvious that such may be the differential strain of the strain gages 64, 65 or it may be the differential load indicated by the load cells 62, 63, the term "strain" is used herein for simplicity only, and includes any load signal which provides an indication of the weight supported by the locks.

A pair of tests 81, 82 determine if certain internal flags have yet been set or not (as described hereinafter); initially they will not have been set, so negative results reach a test 83 to determine if the car has been given a direction command as yet, or not. If not, this means that the car has not been commanded to move, and the pretorque functions are not yet required, so the balance of FIG. 6 is bypassed and other programming is reverted to through the return point 77. But once the car is commanded to have direction, in a subsequent pass through the routine of FIG. 6, an affirmative result of test 83 reaches a step 86 which sets an initial strain (I) equal to the strain of the current cycle (for purposes described hereinafter), a step 87 which sets the armature current of the elevator motor equal to a nominal armature current determined empirically to be essentially that which would be utilized for the weight in the car. The equation of step 87 will have a real nominal current portion in the case of a system having beneath-the-cab load cell weighing system, in which case the weight value is that of the load cells; on the other hand, if there is cross-head type or hitch type of load weighing system, then the nominal value can be zero since the entire weight of the car (including the cab, traveling cable and so forth) shows up in the weight factor. In any event, step 87 will attempt to balance the loaded elevator car frame with suitable armature current for a smooth brake lift. Because the locks are still in place, the car will not move more than a slight amount when the brake is lifted, even if the initial pretorque current is not just right. A step 88 sets an initial flag indicating that the initial strain value has been determined and initial (nominal) pretorque armature current has started to be commanded. Then other parts of the programming are reverted to through the return point 77.

In the next subsequent pass through the routine of FIG. 6, tests 76 and 81 will be negative, but this time test 82 will be affirmative reaching a test 91 which determines if the difference between the current strain and the initial strain is greater than some threshold magnitude, which would indicate that the current in the armature has changed the strain on the car/floor locks 31–34. Since the routine of FIG. 6 may be reached hundreds of times per second, that portion of the controller which establishes armature current actually flowing in the elevator motor may not even have had a chance to work in the next pass through the routine of FIG. 6. Therefore, the threshold is likely not to have been reached in the first few passes through the test 91, so a negative result of test 91 reaches a test 92 to see if a nominal timer has timed out or not (as described hereinafter). Initially it will not have, so a negative result of test 92 reaches a test 93 to see if an associated nominal timer flag has been set yet. In the first pass through test 91 and 92, it will not have been, so a negative result of test 93 reaches a step 96 which initiates a nominal timer to time the establishment of nominal armature current in the elevator motor, and a step 97 which sets a nominal timer flag to keep track of that fact. In the next subsequent pass through the routine of FIG. 6, tests 76 and 81 are negative, test 82 is positive and it is assumed that test 91 will be negative; this time, test 92 will be negative because the nominal timer will not have timed out as yet, and test 93 will be affirmative since the flag has been set, so other programming is reached through the return point 77. The purpose for the nominal timer would typically be achieved in two or three seconds. If the strain has not changed by that time, it may be because the nominal current is very close to the required current. In any event, if the strain changes by the threshold amount, or after the nominal timer times out, an affirmative result of either test 91 or 92 will reach a step 100 to set a lift brake command and a step 101 to set a balance flag, indicating that the brake will be lifted and actual fine balancing of the current in the armature to match the actual load can commence.

Once the brake is lifted, in a subsequent pass through the routine of FIG. 6, test 76 is negative but test 81 is now positive reaching a test 104 to see if the system is sufficiently balanced so that the strain measured in the current cycle is less than some minimum strain which is insufficient to hamper the retrieval of the bolts 37 or 47 of the car/floor locks 31–34. Initially, the strain may not be at such a minimum, so a negative result of test 104 reaches a test 105 to see if an increment timer flag has been set or not. Initially it will not have, so a negative result of test 105 reaches a step 106 in which a current increment is set equal to some constant times the strain remaining in the current cycle. If the strain is positive, that means the weight of the car is excessive, and more current is required to balance it. If the strain is negative, that means the car is light and is forcing the upper sides of the bolts 37, 47 so less current is required to balance it. A step 107 increments the armature current by the increment determined in step 106 and an increment timer is initiated in a step 108. Then the increment timer flag 109 is set to indicate that from now on, only increment time out will allow incrementing the armature current. This feature of having an increment timer allows the motor time to respond to the increment provided in step 107 before incrementing again; providing this lag avoids overshoot in reaching the desired result of a minimal strain due to a totally balancing armature current.

In the next pass through the routine of FIG. 6, test 76 is negative, test 81 is positive, if the minimum strain has not yet been reached, test 104 is negative, and since the timer flag has been set in step 109, test 105 will be positive, reaching a test 112 to see if the increment timer has timed out yet, or not. Initially it will not have so a negative result of test 112 will reach the return point 77. If test 104 continues to be negative, eventually the increment timer will time out so that an affirmative result of test 112 will allow the steps 106 and 107 to apply an additional increment to the armature current. The increment timer is again initiated, and the flag is redundantly set, as before. This process will continue, testing the strain in test 104 to see if it has reached minimum, and periodically incrementing the armature current to try to reach the balance point in the steps 106 and 107. Eventually, which may take one or two seconds, the strain will be reduced to some minuscule amount, and an affirmative result of test 104 will reach a series of steps 113–116 which reset the initial flag, nominal timer flag, balance flag, and increment timer flag. And then, a step 117 provides a retract car/floor lock signal. This will in turn alter the car/floor lock signal in one way or another to cause the locks to retract. For instance, this signal may be utilized in FIG. 3 to reverse the current provided to the jack screw motor 44 and cause the armature 43 to rotate in a direction so that the threaded shaft 42 is advanced to the fully retracted position, where it can operate the microswitch 69 to shut the motor 44 off. In the embodiment of FIG. 4, the signal established in step 117 may simply cause current of the correct polarity in the solenoid 60, so that the bolt 47 will retract fully to the right in FIG. 4. Then, the microswitch 69 and/or the proximity sensor 70 may be utilized in controls which require retraction of the locks before car motion occurs, such as is set forth in the aforementioned application Ser. No. 08/564,534.

In the disclosed embodiment, the elevator motor armature current is utilized as a torque command to the motor to achieve a torque which balances the total weight of the car frame (including the counterweight, a traveling cable, and a cab, if any). However, depending upon the particular motor used to drive the elevator, any suitable torque command signal can be utilized in place of the armature current command generated in step 107 herein.

The time out period for the increment timer should be selected appropriately in dependence upon the response and other characteristics of the elevator motor drive system with which the invention is used. This period of time may be one or several seconds or less than a second, defined herein as on the order of one second or less.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system comprising:

a motor;

a brake;

a roped elevator car frame vertically movable between landings in a building by said motor, the vertical motion of said elevator car being arrestable by said brake;

a car/floor lock selectively engaged by a signal, said lock including a bolt which, when the lock is engaged, extends between said elevator car frame and said building to prevent vertical motion of said elevator car frame;

means providing a load signal indicative of the weight of the elevator car frame being supported by said bolt; and signal processing means for providing a lock signal to engage said lock when said car frame comes to rest at a landing, for providing a lift brake command signal at the commencement of a run of said elevator, said signal processing means responsive to said load signal, after elevator brake lift has been commanded, for providing a torque command signal to said motor of a magnitude and direction to reduce said weight toward zero, and in response to said weight being below a minimum threshold magnitude, for altering said lock signal so as to cause said bolt to retract to thereby permit vertical motion of said car frame.

2. A method of operating an elevator system having a roped car frame moveable vertically in a hoistway between floor landings in a building by a motor, and arrested from vertical motion by a brake, said system having car/floor locks which are operable to lock the car frame to a floor landing when the car frame is disposed thereat, thereby to prevent vertical motion of said car frame, comprising the steps of:

(1) when said car frame is motionless at one of said floor landings with said brake engaged (a) operating said car/floor locks; and (2) in preparation to make a run between landings (b) releasing said brake;

(c) measuring the load on said locks and providing a load signal indicative of the weight of said car frame being supported by said locks;

(d) in response to said load signal, providing to said motor a torque command signal to provide motor torque to reduce said weight toward zero; and (e) in response to said load signal indicating that said weight is below a minimum threshold amount, retracting said locks so said car frame can be moved vertically.

3. A method according to claim 2 wherein said step (b) comprises:

(b1) providing a nominal torque command to said motor; and (b2) thereafter releasing said brake.

4. A method according to claim 3 wherein said step (f) comprises:

(b3) measuring the load on said car frame; and (b4) providing a nominal torque command to said motor which is dependent on the measured load on said car frame.

5. A method according to claim 3 wherein said step (d) comprises:

(a1) providing an increment to said nominal torque command to adjust said motor torque to reduce said weight toward zero.

6. A method according to claim 2 wherein said step (d) comprises:

(a2) providing a nominal torque command signal;

and repetitively (a3) incrementing said nominal torque command signal in proportion to said load signal;

(a4) waiting for a period of time;

(a5) and then either performing step (e) or repeating steps (a3) and (a4).

7. A method according to claim 6 wherein said period of time is on the order of a second or less.

* * * * *